US005944128A

United States Patent [19]

Truax et al.

[11] Patent Number: 5,944,128

[45] **Date of Patent: *Aug. 31, 1999**

[54] MATRIX HARD FACING BY LOST WAX PROCESS

[75] Inventors: David Truax, Houston; Douglas Caraway, Kingwood, both of Tex.; Stephen M. Evans, Standish; Andrew Murdock, Stonehouse, both of United Kingdom

[73] Assignee: Camco International (UK) Limited, Stonehouse, United Kingdom

[ * ] Notice: This patent is subject to a terminal disclaimer.

[21] Appl. No.: 09/019,877

[22] Filed: Feb. 6, 1998

Related U.S. Application Data

[63] Continuation of application No. 08/584,852, Jan. 11, 1996, Pat. No. 5,732,783.

[30] Foreign Application Priority Data

Jan. 13, 1995 [GB] United Kingdom ..... 9500659

[51] Int. Cl.[6] ..... E21B 10/08

[52] U.S. Cl. ..... 175/374; 175/425

[58] Field of Search ..... 76/108.2, 108.4; 175/331, 374, 425

[56] References Cited

U.S. PATENT DOCUMENTS 4,667,756 5/1987 King et al. .

5,732,783 3/1998 Truax et al. ..... 175/374

FOREIGN PATENT DOCUMENTS 9001384 2/1990 WIPO .

*Primary Examiner*—William Neuder

[57] ABSTRACT

A drill bit comprises a main body part having a shank for connection to a drill string, an end face, an internal passage for supplying drilling fluid to the end face, a number of blades extending from the end face outwardly and longitudinally of the central axis of rotation of the bit, and a number of cutters mounted on each said blade. Each blade comprises a central metal core at least partly surrounded by solid infiltrated matrix material. A method of manufacturing such a drill bit includes the steps of forming a main body part from metal, applying to the outer surface of the main body part a coating layer of wax which liquefies at elevated temperature, applying to the coated body part mold-forming material to provide a self-supporting mold surrounding the coated body part, and raising the temperature of the body and surrounding mold sufficiently to liquefy the coating material. The liquefied coating is then drained from the mold, and the cavities left by the coating material are packed with powdered matrix material, which is then infiltrated with a binder alloy at elevated temperature to form a solid infiltrated matrix layer, on the bit body part, corresponding to the layer of wax previously applied.

3 Claims, 3 Drawing Sheets

MATRIX HARD FACING BY LOST WAX PROCESS

This is a Continuation Application of U.S. patent application Ser. No. 08/584,852, filed Jan. 11, 1996, now U.S. Pat. No. 5,732,783.

BACKGROUND OF THE INVENTION

1. Field of the Invention

The invention relates to rotary drill bits for use in drilling or coring deep holes in subsurface formations, and to the manufacture of such bits.

2. Description of Related Art

In a first aspect the invention relates to drill bits of the kind comprising a main body part having a shank for connection to a drill string, an end face, an internal passage for supplying drilling fluid to said end face, a plurality of blades extending from said end face outwardly and longitudinally of the central axis of rotation of the bit, and a plurality of cutters mounted on each said blade, each blade comprising a central metal core at least partly surrounded by solid infiltrated matrix material.

The solid infiltrated matrix material is formed by a powder metallurgy process in which a hollow mould is provided in the required configuration of the outer surface of the bit body, or a part thereof. The main body part of the bit is located within the mould and the spaces between the main body part and the internal surfaces of the mould are packed with powdered hard material, usually tungsten carbide, which is then infiltrated with a molten metal alloy, such as a copper alloy, in a furnace so as to form a hard solid infiltrated matrix. (The term "solid infiltrated matrix" will be used herein to refer to the whole solid metallic material which results from the above process, i.e. tungsten carbide or other hard metal powder surrounded by solidified alloy which has been caused to flow, when in the molten state, into the mass of hard metal powder. The term "matrix" is the term commonly used for such material in the drill bit industry, notwithstanding the fact that, in strict metallurgical terms, it is the infiltration alloy alone which forms a matrix, in which the hard metal particles are embedded.)

In a drill bit of the above-mentioned kind the matrix material, which is highly resistant to erosion and abrasion, provides the outer surface of the blades and, usually, at least a part of the outer surface of the main body part and end face of the drill bit. However, the cast matrix material is comparatively brittle and the central metal core of each blade, which will normally be of a more ductile material, provides reinforcement of the matrix material. This is particularly desirable with bit designs where the stand-off of the blades from the end face is large.

A drill bit of this kind is disclosed in U.S. Pat. No. 4,667,756. In the arrangement described in that specification the main body part of the bit comprises a metal mandrel and each of the blade reinforcement cores is tack-welded, glued, press fitted, brazed or otherwise attached to the metallic mandrel. When the matrix is cast each core, and its attachment to the mandrel, is wholly enclosed with the infiltrated matrix material.

The present invention provides, in a first aspect, an improved method of manufacturing a drill bit of the kind first referred to above.

SUMMARY OF THE INVENTION

According to this aspect of the invention a method of manufacturing a drill bit of the kind first referred to includes the steps of providing a metal mandrel having said shank and internal passage, providing on said mandrel, so as to be supported thereby, a plurality of blade core structures each having a core portion extending outwardly and longitudinally of the central axis of the mandrel, casting infiltrated matrix material around at least a part of each core structure and around at least a part of said mandrel to form the aforesaid blades, and then removing portions of said core structures to detach each core structure from support by the mandrel to leave within each blade a core which is substantially wholly supported by the surrounding matrix material.

Each said core structure may be initially integral with said mandrel. Preferably, however, the core structures are separately formed from the mandrel and are temporarily supported adjacent the mandrel before and during the matrix casting process. Preferably the core structures are temporarily supported on the mandrel itself.

The core structures may be initially interconnected to form a unitary structure which is temporarily supported on or adjacent the mandrel and locates the core portions in the required positions relative thereto. For example, the unitary structure may comprise a spider which is located generally coaxially with the mandrel and from which spider the core structures extend longitudinally of the mandrel.

Preferably the portions of the core structure which are to be removed after the matrix infiltration process are left exposed by said process. However, the invention does not exclude arrangements where said portions to be removed are at least partly coated with matrix material during the matrix forming process, and part of said matrix material is removed with said portions.

Said portions of the core structures may be removed by any suitable method, such as machining or grinding.

The mandrel and core structures may be formed from steel, and the cast matrix may comprise tungsten carbide particles infiltrated by a copper alloy binder, in known manner.

The invention includes within its scope a drill bit comprising a main body part having a shank for connection to a drill string, an end face, an internal passage for supplying drilling fluid to said end face, a plurality of blades extending from said end face outwardly and longitudinally of the central axis of rotation of the bit, and a plurality of cutters mounted on each said blade, the main body part comprising a metal mandrel at least partly surrounded by solid infiltrated matrix material and each blade comprising a central metal core at least partly surrounded by matrix material, said central metal cores being unconnected to said metal mandrel other than by said matrix material.

In one embodiment a part of said central metal core of each blade is received in a recess in the metal mandrel and is at least partly retained in said recess by solid infiltrated matrix material which fills the recess around said part of the metal core.

According to a second aspect of the invention there is provided a drill bit of the kind comprising a main body part having a shank for connection to a drill string, an end face, an internal passage for supplying drilling fluid to said end face, a plurality of blades extending from said end face outwardly and longitudinally of the central axis of rotation of the bit, and a plurality of cutters mounted on each said blade, said main body part comprising a metal mandrel incorporating said shank and internal passage and a plurality of blade core portions integrally formed with the mandrel, said blade core portions extending outwardly and longitudinally of the central axis of rotation of the bit, said metal mandrel and blade core portions being at least partly surrounded by solid infiltrated matrix material to form said main body part and blades.

Since the central reinforcing cores of the blades are integral with the metal mandrel forming the main body part of the bit, they need not rely on the strength of the matrix material for their attachment to the mandrel and consequently the thickness of the coating of matrix material around the cores may be substantially reduced, when compared with the prior art, the dimensions of the cores being correspondingly increased. This may not only increase the strength of the blades, thus permitting higher blade standoffs from the end face of the bit body, but may also reduce the cost of the bit since the matrix materials are generally of substantially greater cost than the material of the mandrel and cores.

The mandrel including the integral cores may be machined from a single unitary blank of metal, for example steel, or may be manufactured by casting.

It will be appreciated that, instead of the cores being integral with the metal mandrel, a layer of matrix substantially thinner than that allowed by the prior art will also be permitted if the blade cores are otherwise sufficiently strongly mounted on, and supported by, the metal mandrel.

Accordingly, the invention includes within its scope a drill bit comprising a main body part having a shank for connection to a drill string, an end face, an internal passage for supplying drilling fluid to said end face, a plurality of blades extending from said end face outwardly and longitudinally of the central axis of rotation of the bit, and a plurality of cutters mounted on each said blade, each blade comprising a central metal core forming part of the main body part, said main body part including the metal cores being at least partly surrounded by a layer of solid infiltrated matrix material having an average thickness of not more than about 10 mm. Preferably the layer of cast matrix material has an average thickness of about 8 mm.

It will be appreciated that, by having such a thin layer of matrix material it may be necessary to so shape the cores of the blades as to allow for the provision in the blades of sockets to receive the aforesaid cutters which are mounted on each said blade. For example, each metal core may be provided with a plurality of spaced recesses registering with sockets or recesses in the matrix layer to receive cutters.

The invention also provides a method of manufacturing a rotary drill bit of any of the kinds referred to above, as well as other types of drill bit having a solid infiltrated matrix surface coating.

Accordingly, the invention provides a method of manufacturing a rotary drill bit which includes the steps of forming a main body part from metal, applying to at least a part of the outer surface of the main body part a coating layer of wax or other coating material which liquefies at elevated temperature, applying to at least the coated body part mould-forming material to provide a self-supporting mould surrounding the coated body part, raising the temperature of the body and surrounding mould sufficiently to liquefy the coating material and drain it from the mould, packing the cavities left by the coating material with powdered matrix material, and infiltrating said matrix material with a binder alloy at elevated temperature to form a solid infiltrated matrix layer on the bit body part corresponding to the layer of coating material previously applied.

DETAILED DESCRIPTION OF THE PREFERRED EMBODIMENTS

Figure 1:
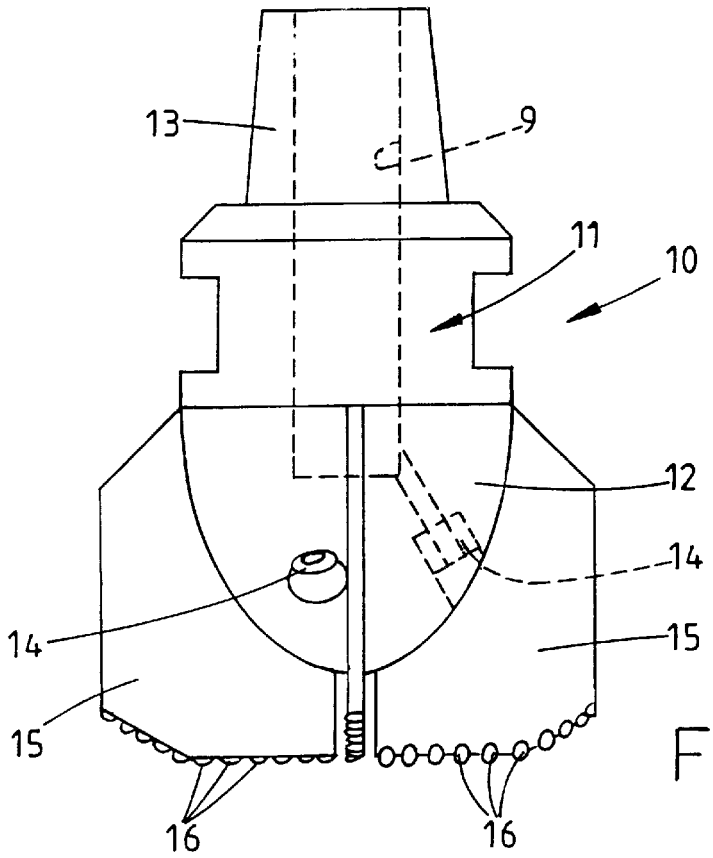
FIG. 1 is a diagrammatic side elevation of a drill bit which is an example of the basic kind to which aspects of the present invention relate.

Referring to FIG. 1, a drag-type rotary drill bit 10 comprises a bit body 11 having a domed end face 12 and a shank including a tapered threaded pin 13 for connecting the drill bit to a drill string. The bit body is formed with a central longitudinal passage 9 which communicates with nozzles 14 in the end face 12 for delivering drilling fluid under pressure to the end face during drilling.

Equally spaced about the domed end face 12 of the bit are a plurality of blades 15, in this case four blades, along the edges of which are spaced a plurality of cutters 16. The cutters 16 may comprise circular or part-circular preform cutting elements each including a front thin cutting table of polycrystalline diamond bonded to a thicker substrate of cemented tungsten carbide. The cutters may be directly mounted on the blades 15, being received in recesses or sockets therein, or may be mounted on carrier posts or studs, usually also of tungsten carbide, which are received in recesses or sockets in the blades 15.

The general details of construction of drill bits of this type are well known and will not therefore be described in further detail.

Rotary drill bits of this kind are commonly formed by one of two basic methods. In one method of construction the bit body 10, including the blades 15, is machined from a solid blank of machinable metal, usually steel. Since the end face and blades of a steel-bodied bit are susceptible to wear and erosion during use, particularly in the vicinity of the cutters and of the nozzles 14 from which drilling fluid emerges at high velocity, it is common to increase the wear resistance of the bit by applying a hard facing to the bit end face and blades. The various hard facing materials and methods are well known.

In an alternative method of construction, the lower parts of the bit body are formed by a powder metallurgy process. In this process a hollow mould is formed, for example from graphite, in the required configuration of the lower part of the bit body, comprising the domed end face 12 and the blades 15. A shaped machined steel mandrel is then located in the mould which is then packed, around the mandrel, with a powdered matrix-forming material, such as powdered tungsten carbide. The upper part of the mandrel is shaped to provide the shank of the bit body 10 and the pin 13, and the lower part is shaped to provide a supporting surface for the surrounding matrix-forming material.

The matrix-forming material is then infiltrated with a metal binder alloy, such as a copper alloy, in a furnace so as to form a hard matrix. In order to form the sockets to receive the cutters, it is usual for formers, also for example of graphite, to be mounted on the interior surfaces of the mould, and/or on the steel mandrel, before it is packed with tungsten carbide. Similarly formers are also provided to form the apertures for the nozzles 14 and the passages leading thereto. After the bit body has been moulded the formers are removed and the cutters and nozzles are located and secured within the resulting sockets in the solid infiltrated matrix material. In the case where the cutters are sufficiently thermally stable, the cutters may themselves be located in recesses in the mould so as to become embedded in the infiltrated matrix. The general method of forming drill bits from matrix material is well known and will not therefore be described in further detail.

In most cases of matrix bits the blades on which the cutters are mounted are formed entirely of matrix material. However, it is recognised that matrix material is comparatively brittle and that it is therefore not unknown for the blades to break under extreme loading. This is particularly likely to occur when the blades have a high stand-off, i.e. extend a considerable distance from the end face 11 of the bit body. It has therefore been proposed in the aforementioned U.S. Pat. No. 4,667,756 to reinforce the matrix blades by mounting on the mandrel metallic extensions which project into the region of the mould where the blades are formed and thus provide an internal supporting core for each blade.

Figure 2:
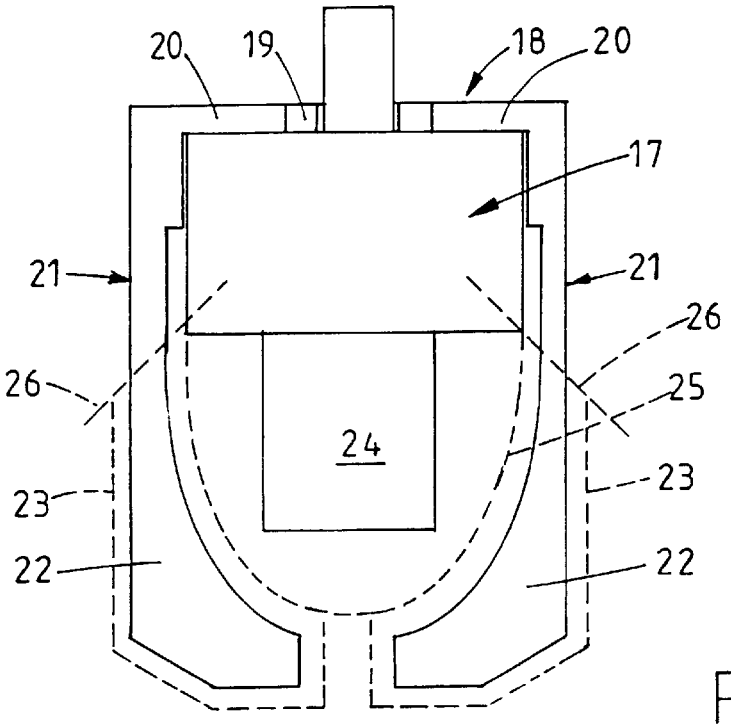
FIG. 2 is a side elevation of a mandrel for use in manufacturing such a drill bit by one method according to the invention.

FIG. 2 shows an improved method for providing such supporting cores. According to this method there is temporarily supported on the steel mandrel 17 a unitary structure 18 which incorporates the blade cores.

The structure 18 comprises an upper spider section which comprises a central circular collar 19 from which extend radially outwards equally spaced arms 20. The number of arms depends on the number of blades, for example three of four, to be formed on the drill bit. From the outer extremity of each arm 20 there depends a core structure 21. The lower portion 22 of each core structure is shaped according to the shape of the blade to be moulded in matrix around the core, as indicated in dotted lines at 23.

The mandrel 17, carrying the unitary core structure 18, is located in an appropriately shaped graphite mould, as before, and infiltrated matrix is moulded around the core portions 22 and the lower portion 24 of the mandrel 27 as indicated in dotted lines at 23 and 25.

Once the moulding process has been completed and the structure removed from the mould, the upper parts of the structure 18 which are not embedded in matrix are removed. For example, in the arrangement shown the downward limbs 21 of the structure may simply be cut along the line indicated at 26, enabling the upper part of the structure to be withdrawn upwardly from the mandrel 17. It will be seen that the cores 22 which remain embedded in the matrix material 23 are then unconnected to the mandrel 17 and are totally supported by the surrounding matrix.

FIG. 2 shows only one method of supporting the cores 22 on the mandrel 17 while the matrix moulding process is taking place. It will be appreciated that alternative supporting arrangements are possible. For example, the core structure may be temporarily bolted, welded or otherwise secured to the mandrel 17. Alternatively, instead of a unitary structure being provided the core structures 21 may be individually secured to the mandrel 17. The core structures might even be integrally formed with the mandrel 17, being machined or cast as a single blank. Instead of the core structures being supported on the mandrel itself, they may be supported by other means adjacent the mandrel so as to be located in the desired positions relative thereto.

In the case where the core structures are integral with the mandrel or secured thereto by welding, the portions of the core structures which remain exposed after the matrix has been moulded may require to be removed by machining, grinding or similar process.

Figure 3:
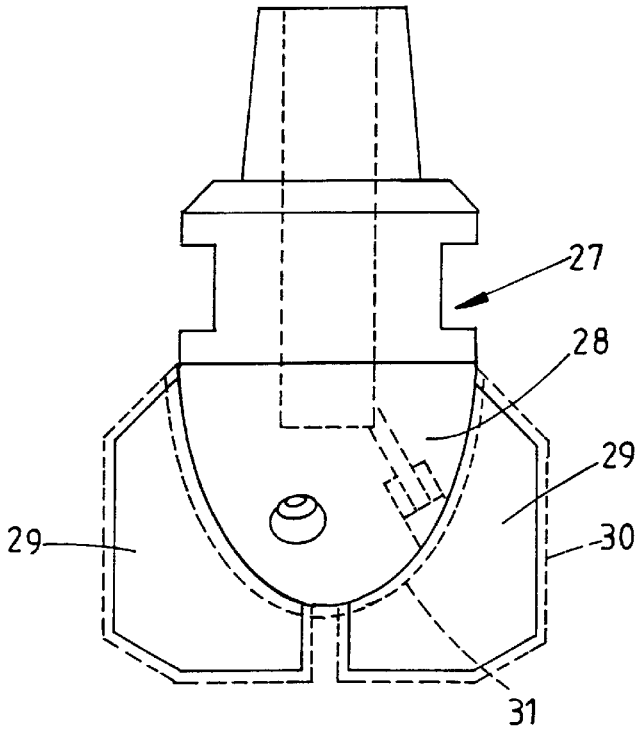
FIG. 3 is a side elevation for an alternative form of mandrel for manufacturing a drill bit by another method according to the invention.

In known arrangements where the matrix material of the blades is formed around a supporting metallic core, the matrix material is of substantial thickness and provides the main bulk of the material of each blade, the core acting simply as a reinforcing element. According to another aspect of the present invention there is provided a drill bit where the cores are only slightly smaller than the required final dimensions of the blades with the result that the resulting layer is comparatively thin. FIG. 3 illustrates diagrammatically a drill bit of this type.

In this case the steel mandrel 27, which may be machined from a blank or cast, is very similar in shape to the final desired shape of the drill bit and comprises a lower domed portion 28 integrally formed with blade reinforcing cores 29. Alternatively, the blade cores 29 may be separately formed and subsequently secured to the mandrel 27 or may be temporarily supported by the method according to FIG. 2. Whichever is the case the cores 29 are only slightly smaller than the interior cavity in the mould so that when the solid infiltrated matrix is moulded around the cores 29 and the lower part 28 of the mandrel only a thin layer of matrix is formed as indicated by dotted lines at 30 and 31. For example, the matrix is preferably not greater than 10 mm in thickness and preferably has an average thickness of the order of 8 mm.

In the prior art arrangements where the matrix is thicker, it is usual for the cutters to be entirely mounted in the matrix. In the present case where the matrix is much thinner, the cores 29 may require to be formed with sockets or recesses to receive the cutters or parts thereof. For example, formers of graphite may be located in preformed sockets or recesses in the blade cores 29 so as to provide registering sockets or recesses in the matrix material moulded around the cores.

The matrix material may be moulded by using a conventional graphite mould as previously described. However, the present invention also provides a new alternative method for applying the matrix and this will now be described with reference to FIG. 4.

Although the method will be described in relation to a bladed drill bit of the kind described with reference to FIG. 1, it will be appreciated that it may also be applicable to other designs of drill bit where a matrix hard facing requires to be applied to a bit body which is formed from steel or other metal. The method, in its general application, is therefore an alternative to the methods of applying a matrix hard facing to a metal bodied bit described in our British Patent Specification No. 2211874.

Figure 4:
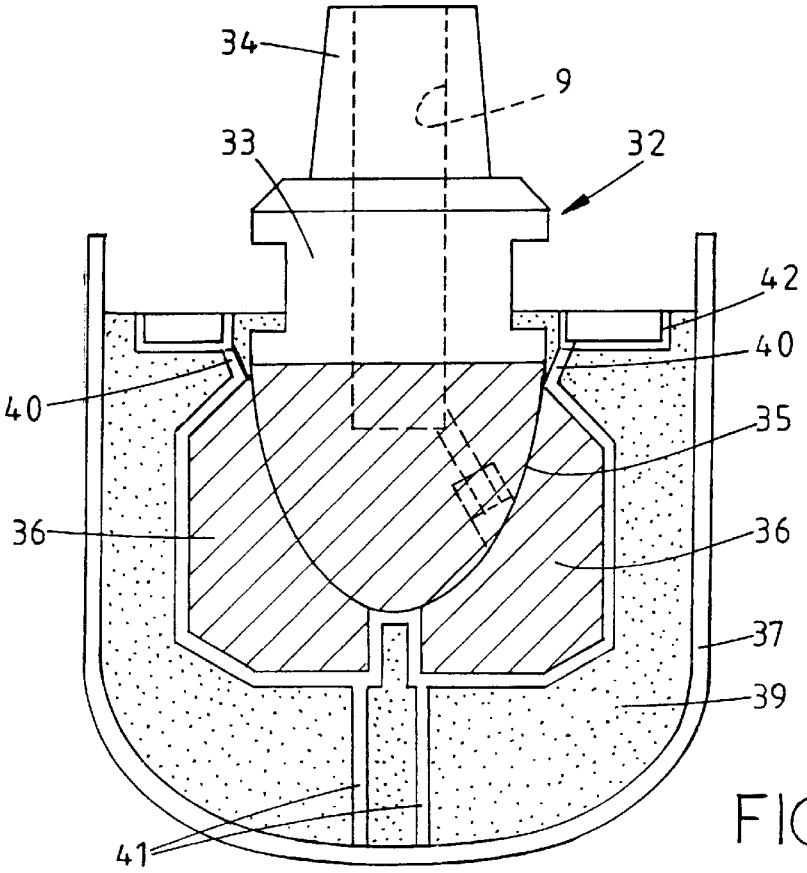
FIG. 4 is a diagrammatic vertical section through a mandrel and mould in a further method according to the present invention.

The method is basically a "lost wax" casting method. Referring to FIG. 4: a main body part 32 of steel or other metal is formed to the required shape by any suitable process. For example, the body part may be formed by machining, casting, forging or fabrication. As shown in FIG. 4 the body comprises a shank 33, a threaded pin 34, a lower end portion 35, and blades 36. The lower portion 35 and blades 36 are under-dimensioned by an appropriate amount, say 2–3 mm, to allow for the application of the matrix hard facing, or by about 8 mm in the case of the matrix cladding previously described with reference to FIG. 3.

Formers of graphite or other suitable heat-resistant material are inserted into pre-machined cutter pockets or recesses in the body 32 and extend beyond the surface of the bit body greater than the intended thickness of the matrix. Gauge protection for the drill bit can be achieved by placing dummies in pre-drilled holes, inserts being pressed or brazed into the holes after the matrix-applying process. Alternatively diamond or carbide tiles may be placed on brass/copper pads which are subsequently attached to the gauge with a high temperature glue, or diamond inserts or tiles may be flame sprayed onto the gauge later in the process of manufacture.

The assembly of the bit body 32 and formers is dipped into a bath of liquid wax one or more times depending on the thickness required, or is sprayed with molten wax or spread with wax in a semi-molten condition, the wax being built up on the bit body to the required thickness of the eventual matrix. Smoothing and finishing of the wax skin is carried out by hand to provide a finished wax coating which is the facsimile of the matrix cladding which is required.

The assembly of the wax-coated steel body is then placed in a heat-resistant pot 37, as shown in FIG. 4, the wax coating being indicated at 38. Room temperature setting sand 39 is then rammed into the pot 37 and around the assembly and allowed to set. Formers are located in the sand 39 to provide inlet passages 40 and outlet passages 41.

The assembly of the bit body surrounded by the solidified sand mould is then removed from the pot 37 and the wax 38 is melted out in an oven at approximately 100–120° C., the wax escaping through the passages 41. The final remnants of wax are then extracted from the assembly by immersing it in a vapour degreasing bath or in a bath of boiling solvent.

The cavity thus left between the bit body 32 and the surrounding mould 39 is then filled with tungsten carbide matrix powder through the inlet passages 40 (the outlet passages 41 having been closed) and is vibrated as with normal matrix bit moulding practice, to consolidate the powder. Instead of the passages 40 in the mould, holes may be drilled in the bit body 32 between the internal bore 9 of the bit body 32 and the upper ends of the lower portion of the body, the cavity being filled through these passages.

An annular channel-section reservoir ring, formed from graphite, is then set in an annular recess machined or moulded in the upper surface of the sand dome, as indicated at 42, and is in communication with the passages 40. A graphite bucket (not shown) is then filled to a depth of 2–3 inches with a dense loose sand, such as heavy zirconia, and is levelled off to form a bed. The assembly is gently placed on the sand bed and more sand is placed around the assembly in the bucket and vibrated. This is repeated until the assembly and reservoir are totally surrounded by sand.

An annulus of the infiltrant alloy is then placed in the reservoir 42 and a sand centre is placed in the central bore of the drill bit. A lid is then placed on the bucket and the whole assembly is subjected to heating in a furnace according to the known process for making matrix-bodied bits. Thus, the infiltrant alloy melts and infiltrates downwards into the matrix powder surrounding the body 32.

After furnacing, the bit can be easily extracted from the bucket and then demolded in the same manner as a conventional matrix bit.

The surfaces of the steel blades 36 and the end face of the lower domed portion 35 of the bit are thus formed with a thin coating of solid infiltrated matrix corresponding to the initial coating of wax. The uncoated parts of the bit are then subjected to the usual machining finishing steps.

This method produces a drill bit which has all the virtues of a machined steel bit but with erosion resistance equivalent to a conventional matrix-bodied bit. It therefore enables what is basically a steel-bodied design of bit to be used in extremely erosive situations.

The method also reduces the cost of the bit, when compared to a conventional matrix-bodied bit, in view of the comparatively high cost of the matrix-forming material. A further advantage is that the layer of wax determines the shape of the mould 39 which is packed around it and it is not therefore necessary to pre-machine a graphite mould as is commonly required in the conventional process of manufacturing matrix-bodied drill bits, again saving cost.

Figure 5:
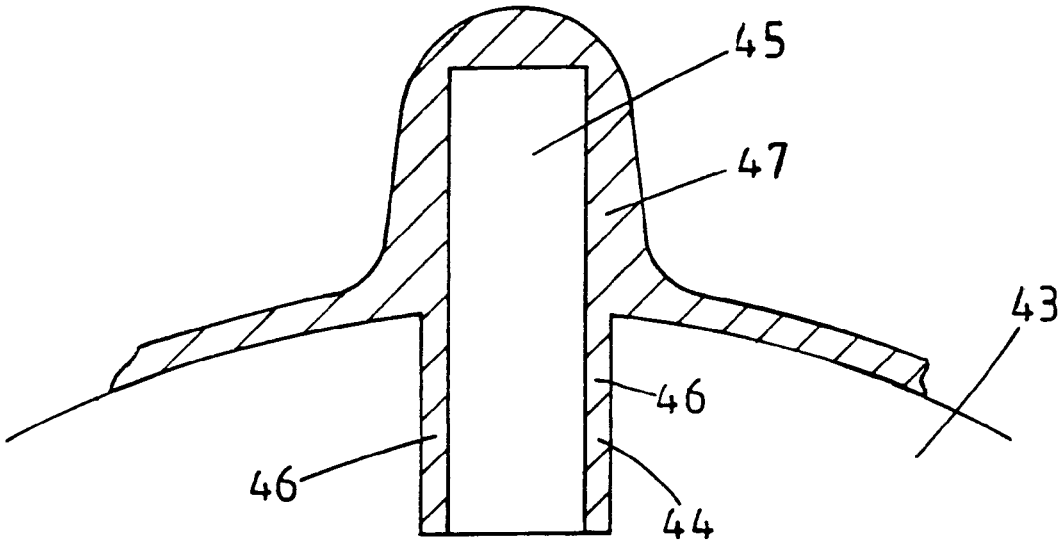
FIG. 5 is a diagrammatic section through part of a mandrel and blade in another embodiment of the invention.

In any of the above arrangements, a part of the central metal core of each blade may be received in a recess in the metal mandrel, and FIG. 5 shows such an arrangement.

In this embodiment the metal mandrel 43 is formed with a slot 44 of generally rectangular cross-section which extends longitudinally of the mandrel at each position where a blade is to be located. The slots 44 are formed by machining the steel mandrel 43. An inner edge portion of the central metal core 45 of the blade is then located in the slot 44. As will be seen from FIG. 5, the width of the slot 44 is greater than the thickness of the blade core 45 so as to leave spaces 46 within the slot 44 on each side of the core 45.

The metal core 45 may be temporarily held in position on the mandrel 43 by any suitable method, including any of the methods described above. Each core 45 is then coated with solid infiltrated matrix material 47, for example, by any of the methods previously referred to. The matrix material fills the spaces 46 between the core 45 and the walls of the slot 44, as well as coating the surfaces of the core 45 which project from the slot and adjacent portions of the outer surface of the mandrel 43. The solid infiltrated matrix 47 thus serves to secure the core 45 to the mandrel.

Whereas the present invention has been described in particular relation to the drawings attached hereto, it should be understood that other and further modifications, apart from those shown or suggested herein, may be made within the scope and spirit of the present invention.

What is claimed:

1. A method of manufacturing a rotary drill bit including the steps of:

forming a main body part from metal;

applying to at least a part of the outer surface of the main body part a coating layer of a material which liquefies at elevated temperature;

applying to at least the coated body part mould-forming material to provide a self-supporting mould surrounding the coated body part;

raising the temperature of the body and surrounding mould sufficiently to liquefy the coating material and drain it from the mould;

packing the cavities left by the coating material with powdered matrix material; and infiltrating said matrix material with a binder alloy at elevated temperature to form a solid infiltrated matrix layer on the bit body part corresponding in configuration to the layer of coating material previously applied.

2. A method according to claim 1, including the step of forming apertures in said main body part and locating formers in said apertures prior to applying said coating layer to the main body part, said formers projecting from the main body part by a distance which is greater than the thickness of said coating layer so that the formers project through said coating layer, said formers being removed and replaced by operative elements of the drill bit after the formation of said solid infiltrated matrix layer on the main body part.

3. A method according to claim 2, wherein at least some of said apertures comprise holes pre-drilled in the main body part and said operative bit elements comprise cutters at least partly inserted into said holes after formation of the solid infiltrated matrix layer and removal of said formers.

* * * * *